US008350140B2

(12) United States Patent
Taniguchi

(10) Patent No.: US 8,350,140 B2
(45) Date of Patent: Jan. 8, 2013

(54) KEYBOARD DEVICE

(75) Inventor: Hirokazu Taniguchi, Tachikawa (JP)

(73) Assignee: Casio Computer Co., Ltd., Tokyo (JP)

( * ) Notice: Subject to any disclaimer, the term of this patent is extended or adjusted under 35 U.S.C. 154(b) by 14 days.

(21) Appl. No.: 13/171,948

(22) Filed: Jun. 29, 2011

(65) Prior Publication Data

US 2012/0000347 A1 Jan. 5, 2012

(30) Foreign Application Priority Data

Jun. 30, 2010 (JP) ..... 2010-148828

(51) Int. Cl.
*G10C 3/12* (2006.01)

(52) U.S. Cl. ..... 84/423 R; 84/433

(58) Field of Classification Search ..... 84/423 R, 84/424–425, 430–431, 434–438
See application file for complete search history.

(56) References Cited

U.S. PATENT DOCUMENTS 6,056,457 A * 5/2000 Chao ..... 400/472
7,427,723 B2 9/2008 Watanabe

FOREIGN PATENT DOCUMENTS

CN 101145340 A 3/2008
CN 101393733 A 3/2009
JP 5-165460 A 7/1993
JP 7-219518 A 8/1995
JP 7-219521 A 8/1995
JP 9-269783 A 10/1997
JP 2001-075568 A 3/2001
JP 2007-328180 A 12/2007
JP 2008-070417 A 3/2008
JP 2008-070766 A 3/2008
JP 2008-076720 A 4/2008
JP 2009-075403 A 4/2009

OTHER PUBLICATIONS

Japanese Office Action dated May 15, 2012 (and English translation thereof) in counterpart Japanese Application No. 2010-148828.
Chinese Office Action dated May 24, 2012 (and English translation thereof) in counterpart Chinese Application No. 201110179245.1.

* cited by examiner

*Primary Examiner* — Kimberly Lockett
(74) *Attorney, Agent, or Firm* — Holtz, Holtz, Goodman & Chick, PC

(57) ABSTRACT

Disclosed is a keyboard device 100, in which a plurality of keys 3 are attached to a keyboard chassis 1 rotatably in a keying direction. In the keyboard device 100, a key pressing member 20 of the keyboard chassis 1 includes sliding portions 26 as protruding parts. Chassis attachment portions 36 of the keys 3 include opening portions 36*a* as recessed parts. A configuration is adopted so that, in a state where the sliding portions 26 and the opening portions 36*a* are engaged with other, the keys 3 can be prevented from dropping off from the keyboard chassis 1, and inclination of the keys 3 in a transverse direction can be suppressed.

5 Claims, 17 Drawing Sheets

KEYBOARD DEVICE

CROSS-REFERENCE TO RELATED APPLICATIONS

This application is based upon and claims the benefit of priority from the prior Japanese Patent Application No. 2010-148828, filed Jun. 30, 2010, the entire contents of which are incorporated herein by reference.

BACKGROUND OF THE INVENTION

1. Field of the Invention

The present invention relates to a keyboard device.

2. Description of Related Art

A keyboard device of an electronic musical instrument such as an electronic piano includes a keyboard chassis and a plurality of keys (white keys and black keys). Generally, for example, an attachment portion to which the keys are attached is provided on a rear portion of the keyboard chassis, and rear end portions of the keys are fitted thereinto, whereby the keys are attached so as to be rotatable in an up-and-down direction.

However, in the case of attaching the keys by fitting the keys concerned as described above, there is an apprehension that the keys may be lifted or drop off at a time when a strong impact is applied to the keys from an outside.

Moreover, on a key tip end side of the keyboard device, key guide portions which guide the keys so that the keys can move only in the up-and-down direction are installed. If key guide portions made of a hard material are used, an abnormal sound occurs. Accordingly, the key guide portions are formed of a material with low hardness. Therefore, for example, in the case where the keys are pushed in a transverse direction or a diagonal direction, the keys have sometimes been inclined in the transverse direction or have sometimes wobbled therein.

Accordingly, heretofore, a device has been known, in which the keys are pivotally supported on the keyboard chassis so as to be freely swingable, and a pressing plate that inhibits lift-up of the rear end portions of the keys is thereafter arranged, whereby a configuration is adopted so as to prevent the lift-up or drop of the keys.

However, as described in Japanese Patent Laid-Open Publication No. H05-165460, in the case where the rear end portions of the keys are merely pressed by the pressing plate from above, smooth motion of the keys is inhibited when the rear end portions are pressed strongly. Meanwhile, it is insufficient if the rear end portions are merely pressed lightly for preventing the keys from being lifted up or dropping and the keys from being inclined and wobbling in the transverse direction when the strong impact is applied thereto.

SUMMARY OF THE INVENTION

In this connection, the present invention has been made in consideration of such circumstances as described above. It is an object of the present invention to provide a keyboard device capable of realizing excellent stability in such a manner that the keys are less likely to drop from the keyboard chassis, and that the inclination and wobbling of the keys are suppressed.

BRIEF DESCRIPTION OF THE DRAWINGS

The accompanying drawings, which are incorporated in and constitute a part of the specification, illustrate presently preferred embodiments of the present invention and, together with the general description given above and the detailed description of the preferred embodiments given below, serve to explain the principles of the present invention in which.

DESCRIPTION OF THE PREFERRED EMBODIMENT

First Embodiment

First, a description is made of a first embodiment of a keyboard device according to the present invention while referring to FIG. 1 to FIG. 9. Note that the scope of the present invention is not limited to the illustrated examples.

Figure 1:
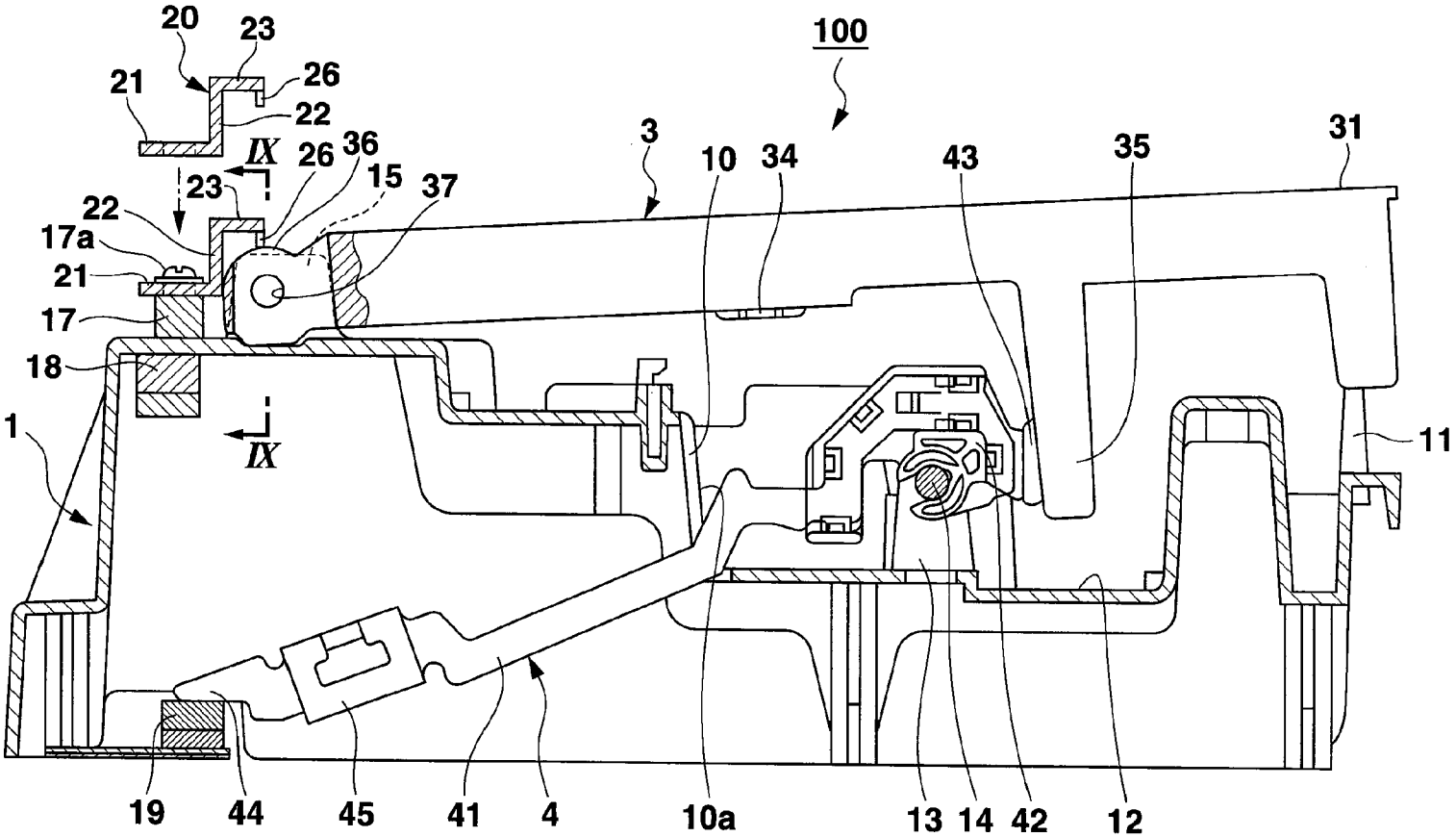
FIG. 1 is a side cross-sectional view of a keyboard device of a first embodiment in an unkeying state.
Figure 2:
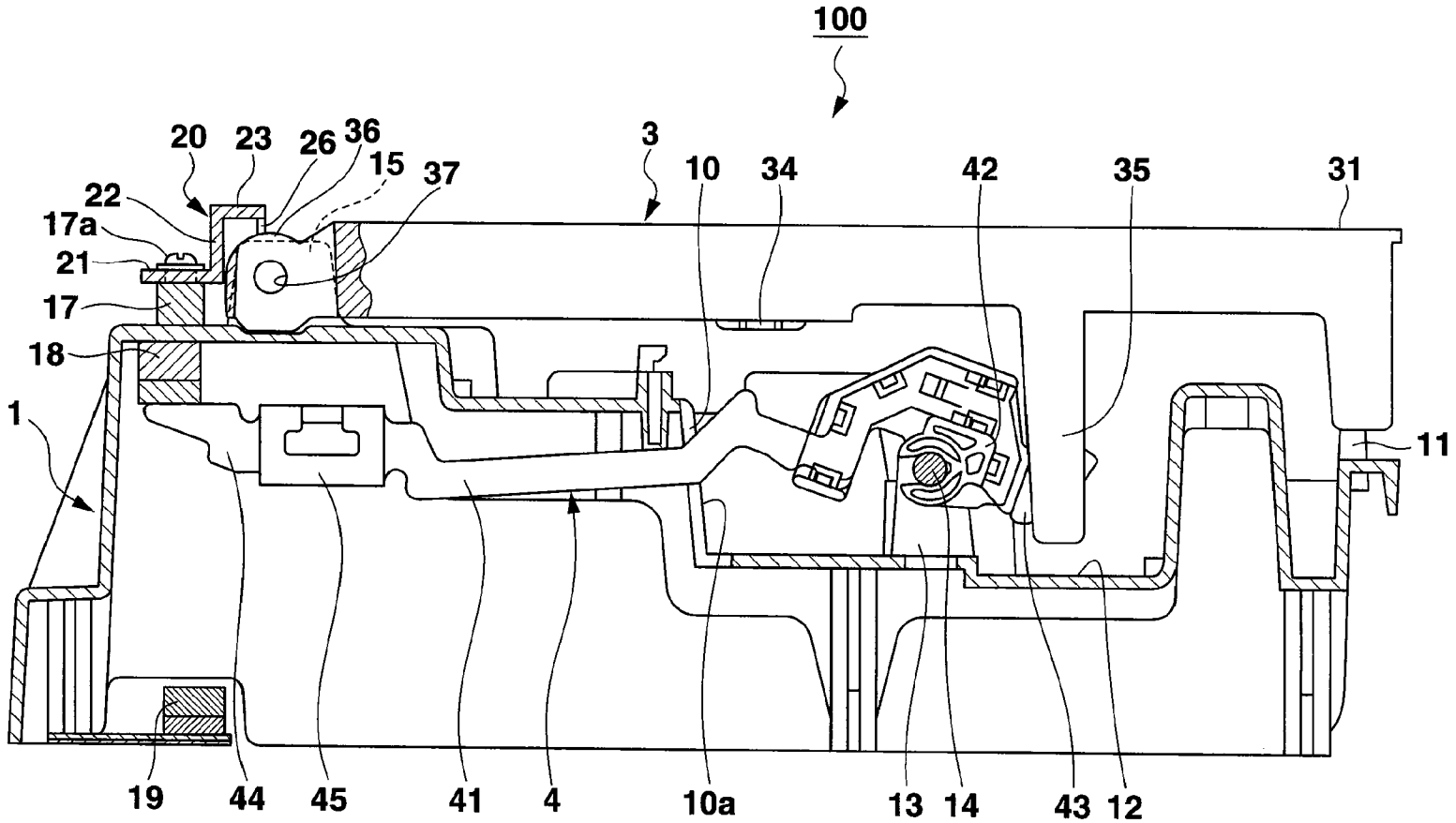
FIG. 2 is a side cross-sectional view of the keyboard device of the first embodiment in a keying state.

FIG. 1 and FIG. 2 are side cross-sectional views of a keyboard device in this embodiment. FIG. 1 shows a state where a key is not keyed, and FIG. 2 shows a state where the key is keyed.

As shown in FIG. 1 and FIG. 2, a keyboard device 100 includes: a keyboard chassis 1; a plurality of keys 3 attached onto the keyboard chassis 1 so as to be rotatable in an up-and-down direction (up-and-down direction in FIG. 1) as a keying direction; a plurality of switch portions (not shown), which are provided so as to individually correspond to the plurality of keys 3, and individually output electrical signals in response to the respective pressing operations for the keys 3; and a plurality of hammer members 4, which are provided so as to individually correspond to lower sides of the plurality of keys 3, and are rotationally displaced following the pressing operations for the keys 3, thereby imparts action loads to the keys 3 concerned. The keyboard chassis 1 and such varieties of members attached to the keyboard chassis 1 are housed in a body case (not shown).

In this embodiment, the keyboard device 100 includes, as the keys 3, a plurality of white keys and a plurality of black keys; however, in FIG. 1 and the like, only one white key is shown for the sake of illustration convenience. Note that a configuration of each of the keys 3 and a configuration of attaching each of the keys 3 to the keyboard chassis 1 are common to any of the keys 3.

The keyboard chassis 1 is integrally formed of synthetic resin, for example, such as ABS resin. On a front end portion (right end portion in FIG. 1 and FIG. 2) of this keyboard chassis 1, keyboard guide portions 11 (in FIG. 1 and FIG. 2, only a white key guide portion that guides the white key is illustrated), each of which slides on an inside of a front end portion of the key 3 from below, and guides the front end portion of the key 3, are formed so as to protrude upward from a bottom portion of the keyboard chassis 1 (that is, a lower side in FIG. 1 and FIG. 2).

On a rear side (left side in FIG. 1 and FIG. 2) of each of the key guide portions 11, as shown in FIG. 1 and FIG. 2, there is provided an attachment portion receiving recessed part 12 as a recessed part that receives a hammer attachment portion 35 of the key 3 when the key 3 is keyed and the front end portion thereof falls downward.

On a rear side of this attachment portion receiving recessed part 12, a hammer supporting portion 13 that supports each of the hammer members 4 rotatably is provided. In the hammer supporting portion 13, a hammer supporting shaft 14 that supports the hammer member 4 in the up-and-down direction is provided.

Moreover, on a rear side of the hammer supporting portion 13, an erected portion 10 is formed so as to protrude upward. In this erected portion 10, an opening portion 10*a* that inserts each of the hammer members 4 therethrough is formed.

Furthermore, on a region of the keyboard chassis 1, which corresponds to an intermediate portion of each of the keys 3, a switch board (not shown) is arranged. At a position of this switch board, which corresponds to a switch pressing portion of each of the keys 3, a rubber switch (not shown) as each of the switch portions is provided.

This rubber switch includes, for example, a rubber sheet installed on the switch board. In the rubber switch, dome-like swelling portion is formed at a position corresponding to a switch pressing portion 34 (described later) of each of the keys 3.

The rubber switch and a mechanism for pressing the same are not particularly limited; however, when the key 3 is pressed down, the switch pressing portion 34 provided on the key 3 presses the swelling portion of the rubber switch. In such a way, the swelling portion is elastically deformed, and a movable point of contact provided in an inside thereof contacts a fixed point of contact on the switch board, whereby a configuration is adopted so as to output an ON-signal.

Moreover, on a side further rear of the hammer supporting portion 13 and the rubber switch (that is, the left side in FIG. 1 and FIG. 2), a key supporting portion 15 that supports each of the plurality of keys 3 (white keys, black keys) is provided so as to protrude upward.

This key supporting portion 15 includes a pair of key supporting plates 15*a*. On inner surfaces of the key supporting plates 15*a*, key supporting protruding parts 16 for supporting a rear end portion of each of the keys 3 rotatably are protruded so as to be opposed to each other toward the inside.

Note that a configuration for supporting each of the keys 3 is not limited to that shown here. For example, a configuration may be adopted, in which a key supporting shaft for supporting the rear end portion of the key 3 rotatably is provided in the key supporting portion 15, and the shaft concerned is allowed to support the key 3.

Moreover, on a rear side of the key supporting portion 15, a fixing portion 17 for screw fixing a key pressing member 20 to be described later is provided.

In this embodiment, a key attachment portion that attaches the keys 3 to the keyboard chassis 1 is composed of the key supporting portion 15 and the key pressing member 20.

Figure 3:
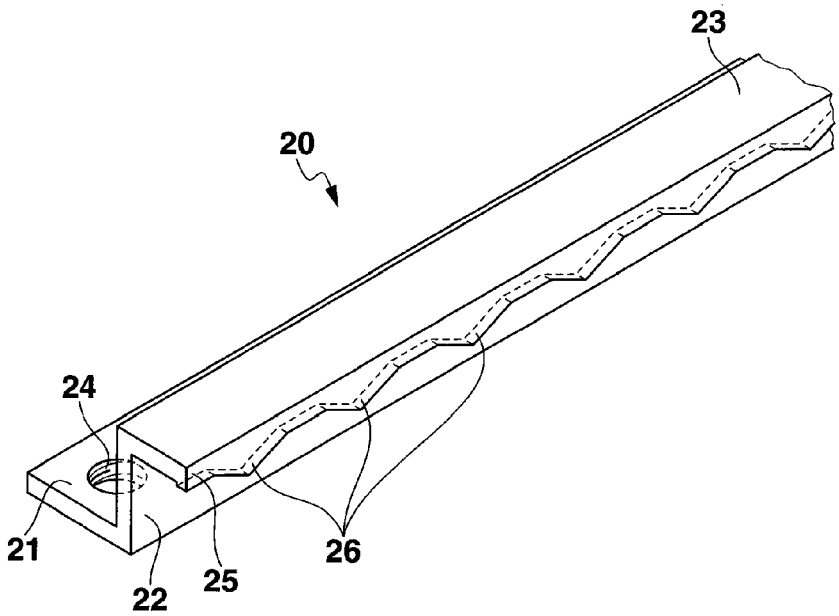
FIG. 3 is a perspective view of a key pressing member of the first embodiment.
Figure 4:
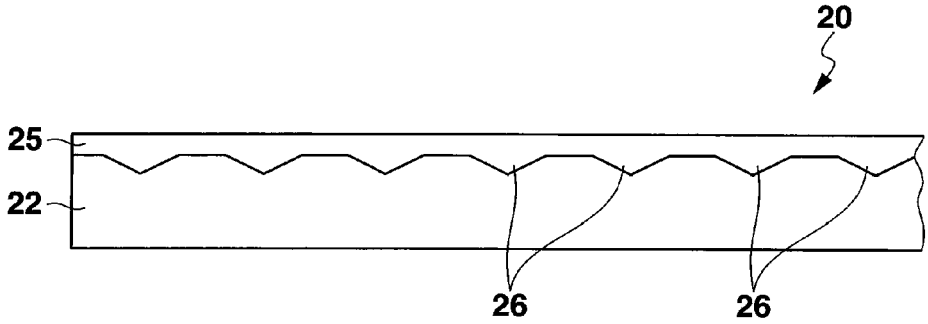
FIG. 4 is a front view of the key pressing member of the first embodiment.
Figure 5:
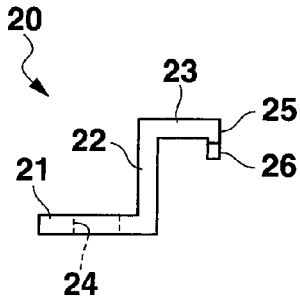
FIG. 5 is a side view of the key pressing member of the first embodiment.

FIG. 3 is a perspective view of the key pressing member 20 fixed to the fixing portion 17. FIG. 4 is a front view of the key pressing member 20 (that is, a view when viewed from a front side (right side in FIG. 1 and FIG. 2) of the keyboard device 100). FIG. 5 is a side view of the key pressing member 20.

As shown in FIG. 3 to FIG. 5, the key pressing member 20 is a long member extended in a width direction of the keyboard device 100 (that is, a transverse direction). The key pressing member 20 includes: a chassis fixing portion 21 with a flat plate shape, in which screw holes 24 are formed at positions corresponding to screw holes (not shown) of the fixing portion 17; an erected portion 22 erected substantially vertically from one longitudinal side of the chassis fixing portion 21; an eave portion 23 extended substantially horizontally from an upper end of the erected portion 22 to an opposite side with the chassis fixing portion 21; and a rib 25 suspended substantially vertically from a longitudinal end portion of the eave portion 23.

On the rib 25, at positions corresponding to the respective keys 3 at the time of fixing the key pressing member 20 to the fixing portion 17, sliding portions 26 are provided, each of which is formed into a mountain shape from a pair of mountain ridge portions inclined toward a widthwise center of the key 3.

Each of the sliding portions 26 is a protruding part, in which a vertex is inserted from an opening portion 36*a* (refer to FIG. 6) of a chassis attachment portion 36 of the key 3, which will be described later, into an inside of the chassis attachment portion 36 as an attached portion, and slides along end edges of the opening portion 36*a* of the chassis attachment portion 36 at the keying time.

Moreover, on a back surface side on an upper side of a rear end portion of the keyboard chassis 1, an upper limit stopper 18 is provided, which regulates an upper limit position of an abutment portion 44 as a tip end portion of each of the hammer members 4 by contacting with an upper surface of the tip end portion of the hammer member 4 at the time when the hammer member 4 is urged clockwise in FIG. 1. Moreover, on a front surface side (upper side in FIG. 1 and FIG. 2) on a lower side of the rear end portion of the keyboard chassis 1, a lower limit stopper 19 is provided, which regulates a lower limit position of the abutment portion 44 of the hammer member 4 by contacting with a lower surface of the abutment portion 44 of the hammer member 4 at the time when the hammer member 4 rotationally moves counterclockwise in FIG. 1.

Each of the upper limit stopper 18 and the lower limit stopper 19 is formed of felt or the like, and is made capable of absorbing an impact, which comes from the abutment portion 44 of the hammer member 4, at the time when the abutment portion 44 concerned contacts with each of the upper limit stopper 18 and the lower limit stopper 19.

In this embodiment, each of the keys 3 is formed of resin or the like, and forms a substantially rectangular shape that is slim.

An inside of the key 3 is made hollow, and the key 3 is formed into a rectangular shape in cross-section opened to a lower side. Into a front side (right end portion side in FIG. 1) in the inside of the key 3, the key guide portion 11 is inserted from a lower side thereof, and the front end portion of the key 3 is guided by the key guide portion 11, whereby a configuration is adopted so that the key 3 cannot swing transversely at the keying time.

The front end side (right end side in FIG. 1) of the key 3 is used as a pressed portion 31 keyed by a player, and a rear end side thereof is prepared as the chassis attachment portion 36 as the attached portion attached to the key supporting portion 15 of the keyboard chassis 1.

Figure 6:
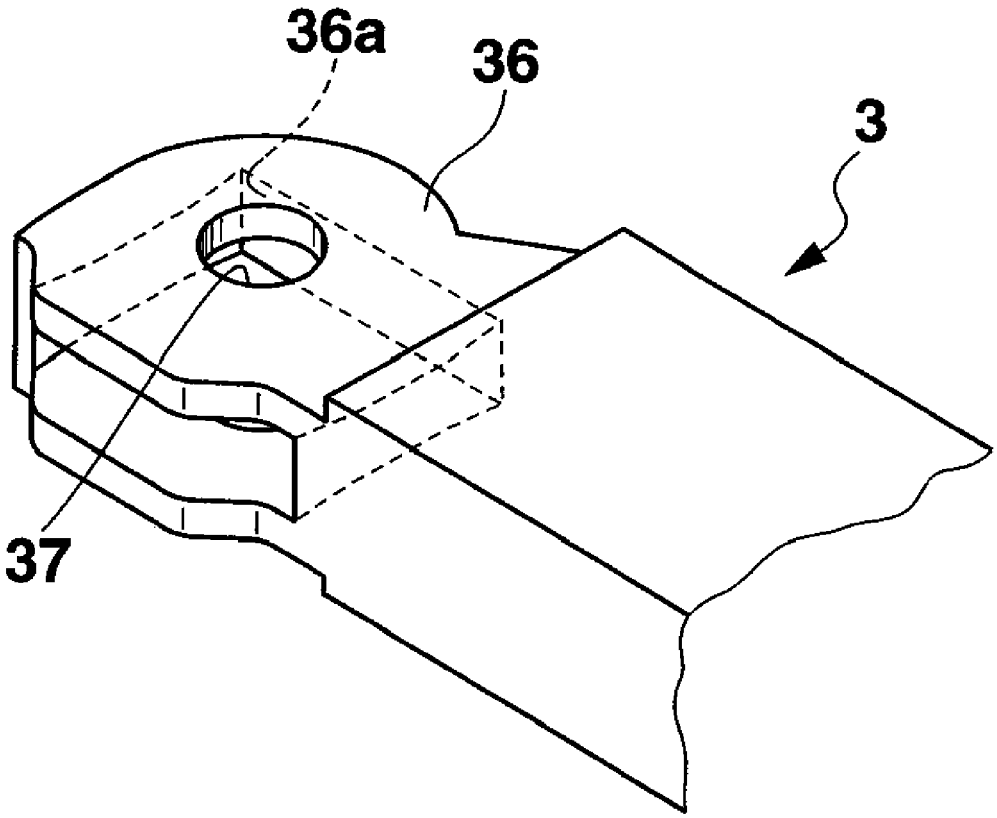
FIG. 6 is a perspective view of a chassis attachment portion of a key in the first embodiment.

FIG. 6 is a perspective view of the chassis attachment portion 36.

As shown in FIG. 6, in this embodiment, in the chassis attachment portion 36, hole portions 37 fitted to the key supporting protruding parts 16 are formed at positions of the key supporting portion 15, which correspond to the key supporting protruding parts 16. The key supporting protruding parts 16 are fitted to the hole portions 37, whereby the key 3 is adapted to rotationally move in the up-and-down direction (that is, the keying direction) about the key supporting protruding parts 16 taken as rotation centers.

With regard to the chassis attachment portion 36, an outer shape of at least an upper portion thereof is formed into a circular arc shape in which a center is located at the key supporting protruding parts 16 (or the hole portions 37 fitted to the key supporting protruding parts 16) as the rotation centers. The chassis attachment portion 36 includes the opening portion 36*a* in the upper portion formed into the circular arc shape. The opening portion 36*a* is a recessed part into which each of the sliding portions 26 as the protruding parts is inserted.

In this embodiment, the opening portion 36*a* (recessed part) and the sliding portion 26 (protruding part) are composed so as to be capable of being engaged with each other. The opening portion 36*a* (recessed part) and the sliding portion 26 (protruding part) are composed so as, in such an engaged state thereof, to prevent the drop of the key 3 from the keyboard chassis 1, and to suppress such inclination and wobbling of the key 3 in the transverse direction.

Note that, in this embodiment, the inside of the chassis attachment portion 36 is opened in an up and down direction; however, it is sufficient if at least the upper portion of the chassis attachment portion 36 is opened, and the chassis attachment portion 36 is not limited to the one having the inside opened in the up and down direction.

Moreover, it is sufficient if a range of the portion formed into the circular arc shape and a range of the opening portion 36*a* have a configuration, in which the sliding portion 26 is capable of sliding along the end edges of the opening portion 36*a* without inhibiting the rotational movement of the key 3 at the time when the key 3 is keyed. These ranges are not limited to the illustrated example.

Furthermore, at the position of the intermediate portion of the key 3, which corresponds to the rubber switch of the switch board provided on the keyboard chassis 1, the switch pressing portion 34 that presses the rubber switch is provided. The switch pressing portion 34 is configured so as to press the rubber switch and allow the rubber switch to output the ON-signal therefrom when the key 3 is operated to be keyed.

Moreover, as shown in FIG. 1, the hammer member 4 includes a hammer body 41 and a hammer holder 42.

The hammer body 41 is formed of metal, in which one end side is attached to the hammer holder 42. Moreover, other end side of the hammer body 41 is formed as the abutment portion 44 that contacts with the upper limit stopper 18 and the lower limit stopper 19, which are provided on the keyboard chassis 1. In the vicinity of the abutment portion 44, a weight 45 is provided.

The hammer holder 42 is formed of resin or the like, in which the hammer body 41 is attached to one end side. Moreover, other end side of the hammer holder 42 is formed as a key attachment portion 43 attached to the hammer attachment portion 35 of the key 3.

The hammer member 4 is inserted through the opening portion 10*a* provided in the erected portion 10 of the keyboard chassis 1 in a state where the hammer body 41 is attached to the hammer holder 42, whereby the hammer member 4 is adapted to be arranged on a back surface side of the keyboard chassis 1.

In the hammer holder 42, a hammer attachment hole portion (not shown) is provided. Then, this hammer attachment hole portion is rotatably attached to the hammer supporting shaft 14 of the hammer supporting portion 13 provided on the keyboard chassis 1, whereby the hammer member 4 is composed so as to rotationally move in the up-and-down direction about the hammer supporting shaft 14.

In the hammer member 4, by weight of the weight 45 provided in the vicinity of the rear end portion (left end portion in FIG. 1) of the hammer body 41, the hammer body 41 is urged counterclockwise in FIG. 1, and the abutment portion 44 on the rear end portion of the hammer body 41 contacts with the lower limit stopper 19 provided on the bottom portion of the rear end of the keyboard chassis 1, whereby the hammer member 4 is composed so that the hammer body 41 can be regulated at the lower limit position. Meanwhile, in the hammer member 4, when the hammer body 41 rotationally moves clockwise in FIG. 1 against the weight of the weight 45, the abutment portion 44 on the rear end portion of the hammer body 41 contacts with the upper limit stopper 18 arranged on the back surface side of the rear end portion of the keyboard chassis 1, whereby the hammer member 4 is composed so that the hammer body 41 can be regulated at the upper limit position.

Figure 7:
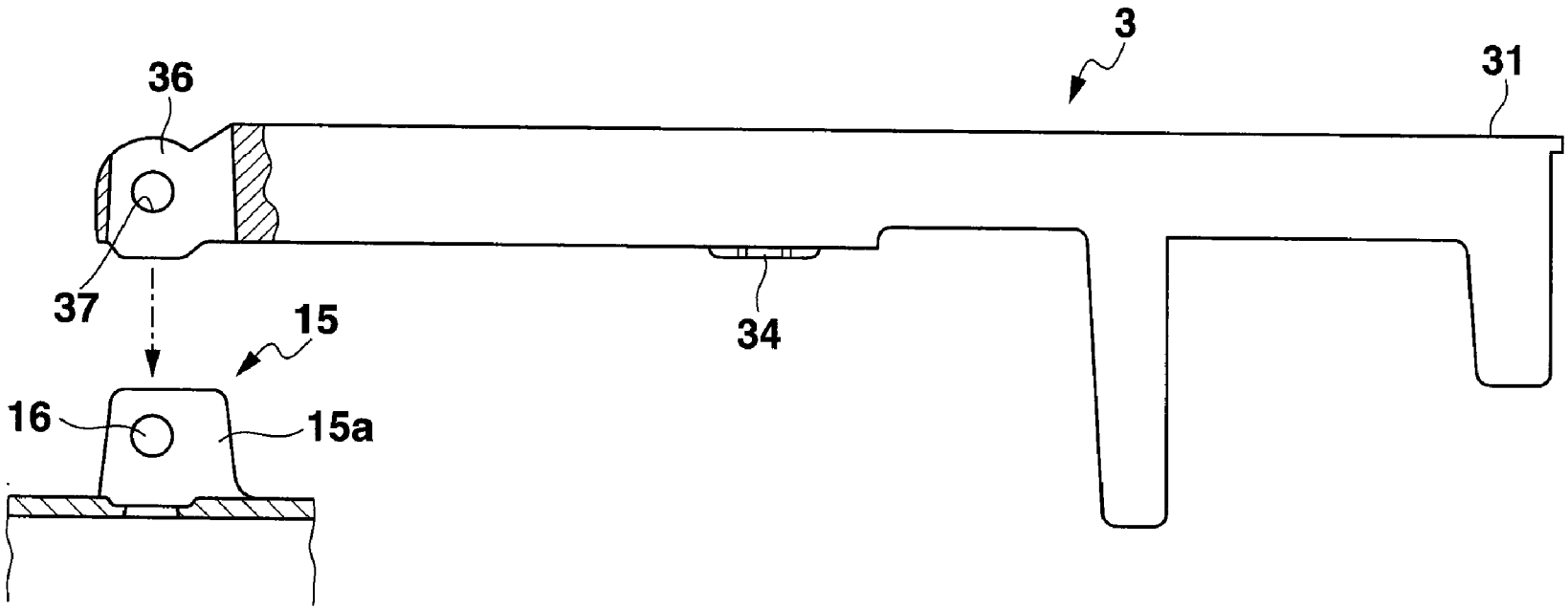
FIG. 7 is a side cross-sectional view explaining a state of fitting the chassis attachment portion of the key into a key supporting portion.
Figure 8:
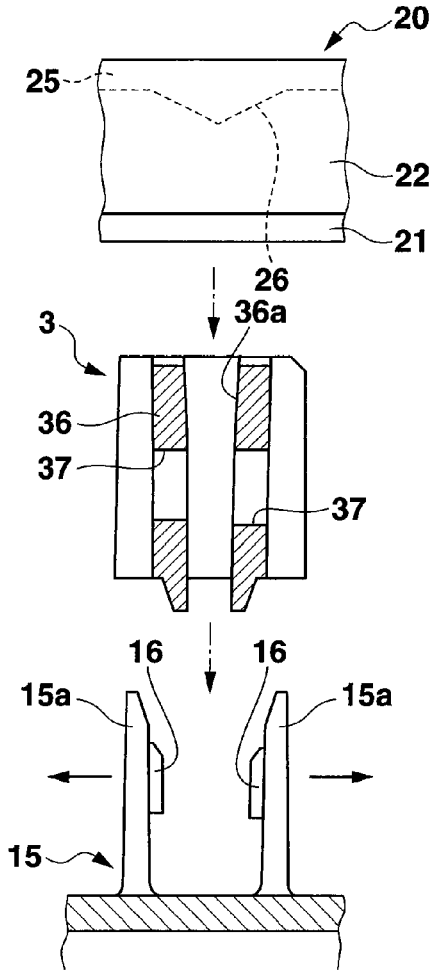
FIG. 8 is an explanatory view of a state of pressing the chassis attachment portion of the key into the key supporting portion by a fit key pressing member when viewed from a rear side of the device.
Figure 9:
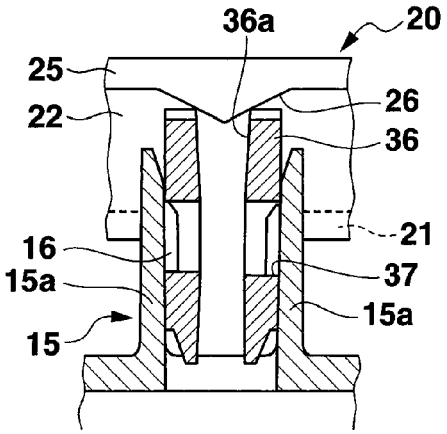
FIG. 9 is a cross-sectional view along a line IX-IX of FIG. 1.

Next, a description is made of functions of the keyboard device 100 in this embodiment while referring to FIG. 7 to FIG. 9 and the like. FIG. 7 is a side cross-sectional view explaining a state of fitting the chassis attachment portion 36 of the key 3 to the key supporting portion 15. FIG. 8 is an explanatory view of a state of pressing the chassis attachment portion 36 of the key 3 into the key supporting portion 15 by the fit key pressing member 20 when viewed from the rear side (left side in FIG. 1 and FIG. 2) of the keyboard device 100. FIG. 9 is a cross-sectional view along a line IX-IX of FIG. 1, which is a view of a state where the key 3 is attached to the keyboard chassis 1 when viewed from the front side (right side in FIG. 1 and FIG. 2) of the keyboard device 100.

When the key 3 is attached to the keyboard chassis 1, as shown in FIG. 7, the chassis attachment portion 36 as the attached portion of the key 3 is fitted from above into the key supporting portion 15 of the keyboard chassis 1. Specifically, as shown in FIG. 8, the pair of key supporting plates 15*a* are expanded in the transverse direction (width direction of the key 3), the chassis attachment portion 36 is inserted therebetween from above, and the key supporting protruding parts 16 are fitted to the hole portions 37 of the chassis attachment portion 36.

Next, the key pressing member 20 is fixed to the fixing portion 17 (refer to FIG. 1 and FIG. 2) by screws 17*a* in such an orientation where the side on which the rib 25 is provided is located on the front side (right side in FIG. 1 and FIG. 2) of the keyboard device 100.

At this time, as shown in FIG. 9, the vertex of the sliding portion 26 of the key pressing member 20, which is formed into the mountain shape, is inserted from the opening portion 36*a* of the chassis attachment portion 36 into the inside of the chassis attachment portion 36, and the mountain ridge portions of the sliding portion 26 are thrust against the end edges of the opening portion 36*a*. In such a way, the chassis attachment portion 36 is pressed from above with uniform force free from right and left imbalance, the lift and drop of the key 3 are prevented, and in addition, the inclination and wobbling of the key 3 in the transverse direction are suppressed.

Then, at the keying time (refer to FIG. 2), the sliding portion 26 slides along the end edges of the opening portion 36*a* of the chassis attachment portion 36 formed into the circular arc shape about the rotation center taken as the center. Therefore, also when the key 3 shifts from an unkeyed state (refer to FIG. 1) to a keyed state (refer to FIG. 2), the sliding portion 26 smoothly slides along the end edges of the opening portion 36*a* while pressing the chassis attachment portion 36 with the uniform force free from the right and left imbalance.

As described above, in accordance with this embodiment, the tip end of the sliding portion 26 of the key pressing member 20, which is the protruding part, is inserted into the inside of the opening portion 36*a* of the chassis attachment portion 36, which is the recessed part. Accordingly, even in the case where a strong impact is applied to the key 3 from the outside, the key 3 can be prevented from dropping off or being lifted from the keyboard chassis 1.

Moreover, at the keying time (refer to FIG. 2), the sliding portion 26 slides along the end edges of the opening portion 36*a* of the chassis attachment portion 36 formed into the circular arc shape about the rotation center as the center. Therefore, no excessive load is applied to the key 3, and the key 3 can be stabilized without interfering with playability.

Moreover, the mountain ridge portions of the mountain shape (wedge shape) of the sliding portion 26 are thrust against the end edges of the opening portion 36*a*, whereby the right and left end edges of the opening portion 36*a* can be pressed with substantially uniform force. Therefore, even if some variations occur in the position and dimension of the sliding portion 26, the key 3 can be pressed toward the center in the width direction thereof with stable force, and the inclination and wobbling of the key 3 can be prevented even if the key 3 is pressed down in the transverse direction and the diagonal direction.

Furthermore, appropriate pressing force can be applied to a basal portion of the key 3 by the key pressing member 20, and accordingly, a natural key touch feeling approximate to that of an acoustic piano can be obtained.

Second Embodiment

Next, a description is made of a second embodiment of the keyboard device according to the present invention while referring to FIG. 10 to FIG. 13. Note that this embodiment is different from the first embodiment in the configuration of the key pressing member, and accordingly, a description is particularly made below of points different from those of the first embodiment.

Figure 10:
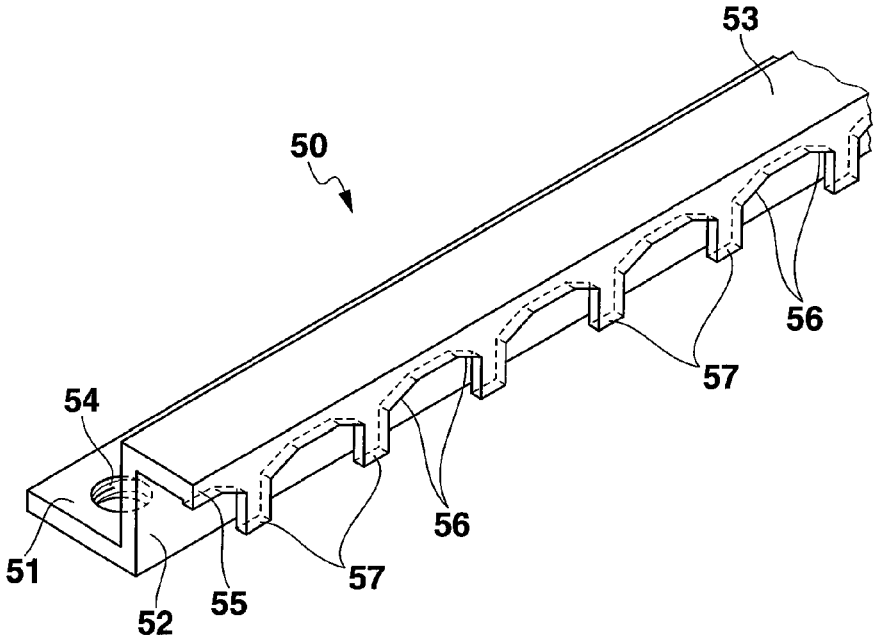
FIG. 10 is a perspective view of a key pressing member of a second embodiment.
Figure 11:
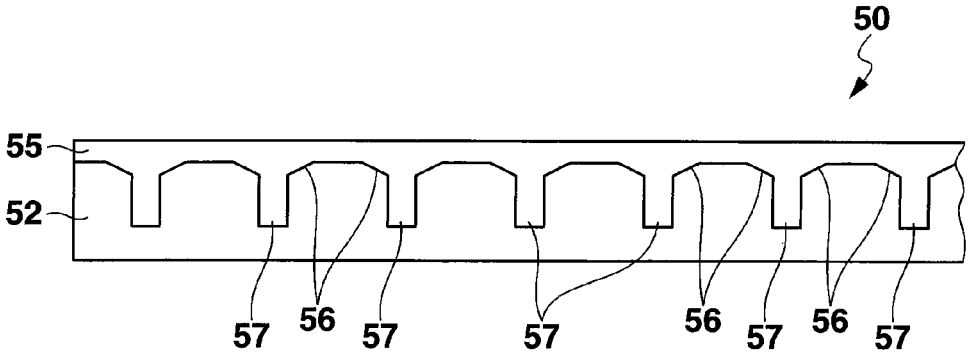
FIG. 11 is a front view of the key pressing member of the second embodiment.
Figure 12:
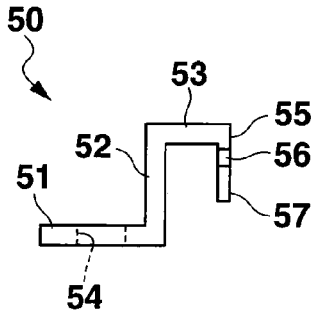
FIG. 12 is a side view of the key pressing member of the second embodiment.

In this embodiment, the keyboard chassis includes: key supporting portions (refer to FIG. 13) substantially similar to those of the first embodiment; and a key pressing member 50 shown in FIG. 10 to FIG. 12. Key attachment portions are composed of the key supporting portions 15 and the key pressing member 50.

FIG. 10 is a perspective view of the key pressing member 50. FIG. 11 is a front view of the key pressing member 50 (that is, a view when viewed from a front side of the keyboard device). FIG. 12 is a side view of the key pressing member 50.

The key pressing member 50 of this embodiment is a long member extended in the width direction of the keyboard device (that is, the transverse direction). As shown in FIG. 10 to FIG. 12, the key pressing member 50 includes: a chassis fixing portion 51 with a flat plate shape, in which screw holes 54 are formed at positions corresponding to screw holes (not shown) of a fixing portion of the keyboard chassis; an erected portion 52 erected substantially vertically from one longitudinal side of the chassis fixing portion 51; an eave portion 53 extended substantially horizontally from an upper end of the erected portion 52 to an opposite side with the chassis fixing portion 51; and a rib 55 suspended substantially vertically from a longitudinal end portion of the eave portion 53.

On the rib 55, insertion pieces 57 are provided at positions corresponding to the respective keys at the time of fixing the key pressing member 50 to a fixing portion. Each of the insertion pieces 57 is a protruding part, which is inserted from the opening portion 36*a* of the chassis attachment portion 36 of the key into the inside of the chassis attachment portion 36, and slides along the end edges of the opening portion 36*a* of the chassis attachment portion 36 at the keying time. The insertion piece 57 is formed to a width dimension, which is smaller than a width dimension of the opening portion 36*a*, and also prevents interference of the insertion piece 57 with wall surfaces of the inside of the chassis attachment portion 36.

Moreover, on both sides of each of the insertion pieces 57, sliding portions 56 are provided, each of which is composed of a pair of mountain ridge portions inclined toward the widthwise center of the key, contacts with the end edges of the opening portion 36*a*, and slides along the end edges of the opening portion 36*a* at the keying time.

Note that other configurations are similar to those shown in the first embodiment, and accordingly, the same reference numerals are assigned to the same members, and a description thereof is omitted.

Next, a description is made of functions of the keyboard device in this embodiment.

When each of the keys is attached to the keyboard device, the chassis attachment portion 36 as the attached portion of the key is fitted from above into the key supporting portion 15 of the keyboard chassis.

Next, the key pressing member 50 is screw fixed to the fixing portion of the keyboard chassis in such an orientation where a side on which the rib 55 is provided is located on the front side of the keyboard device.

Figure 13:
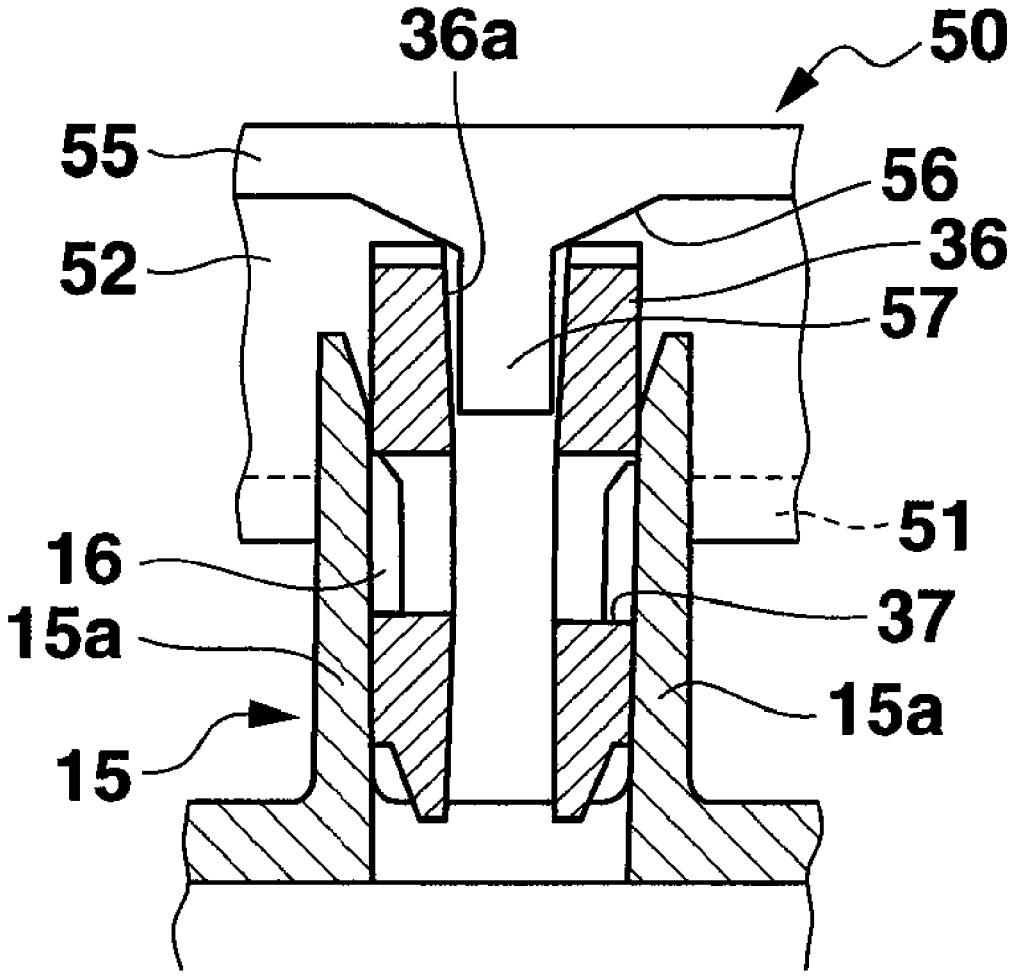
FIG. 13 is a cross-sectional view showing an attachment state of the key to the keyboard chassis in the second embodiment.

At this time, as shown in FIG. 13, the insertion piece 57 of the key pressing member 50 is inserted from the opening portion 36*a* of the chassis attachment portion 36 into the inside of the chassis attachment portion 36, and in addition, the mountain ridge portions of the sliding portion 56 formed on each of both sides of the insertion piece 57 are thrust against the end edges of the opening portion 36*a*. In such a way, the chassis attachment portion 36 is pressed from above with uniform force free from right and left imbalance, the lift and drop of the key are prevented, and in addition, the inclination and wobbling of the key in the transverse direction are suppressed.

Then, at the keying time, in a state where the insertion piece 57 is left inserted into the opening portion 36*a*, the sliding portion 56 slides along the end edges of the opening portion 36*a* of the chassis attachment portion 36 formed into the circular arc shape about the rotation center taken as the center. Therefore, also when the key shifts from the unkeyed state to the keyed state, the sliding portion 56 smoothly slides along the end edges of the opening portion 36*a* while pressing the chassis attachment portion 36 with the uniform force free from the right and left imbalance.

As described above, in accordance with this embodiment, each of the insertion pieces 57 of the key pressing member 50, which are the protruding parts, is inserted into the inside of each of the opening portions 36*a* of the chassis attachment portion 36, which are the recessed parts. Accordingly, even in the case where a strong impact is applied to the key from the outside, the key can be prevented from dropping off or being lifted from the keyboard chassis 1.

Moreover, at the keying time, the sliding portion 56 slides along the end edges of the opening portion 36*a* of the chassis attachment portion 36 formed into the circular arc shape about the rotation center as the center. Therefore, no excessive load is applied to the key, and the key 3 can be stabilized without interfering with the playability.

Moreover, the mountain ridge portions of the sliding portion 56 are thrust against the end edges of the opening portion 36*a*, whereby the right and left end edges of the opening portion 36*a* can be pressed with substantially uniform force. Therefore, even if some variations occur in the positions and dimensions of the sliding portion 56 and the insertion piece 57, the key 3 can be pressed toward the center in the width direction thereof with stable force, and the inclination and wobbling of the key 3 can be prevented even if the key 3 is pressed down in the transverse direction and the diagonal direction.

Furthermore, appropriate pressing force can be applied to the basal portion of the key 3 by the key pressing member 50, and accordingly, the natural key touch feeling approximate to that of the acoustic piano can be obtained.

Third Embodiment

Next, a description is made of a third embodiment of the keyboard device according to the present invention while referring to FIG. 14 to FIG. 18. Note that this embodiment is different from the first embodiment and the second embodiment in the configurations of the chassis attachment portion of the key and the key pressing member, and accordingly, a description is particularly made below of points different from those of the first embodiment and the second embodiment.

Figure 14:
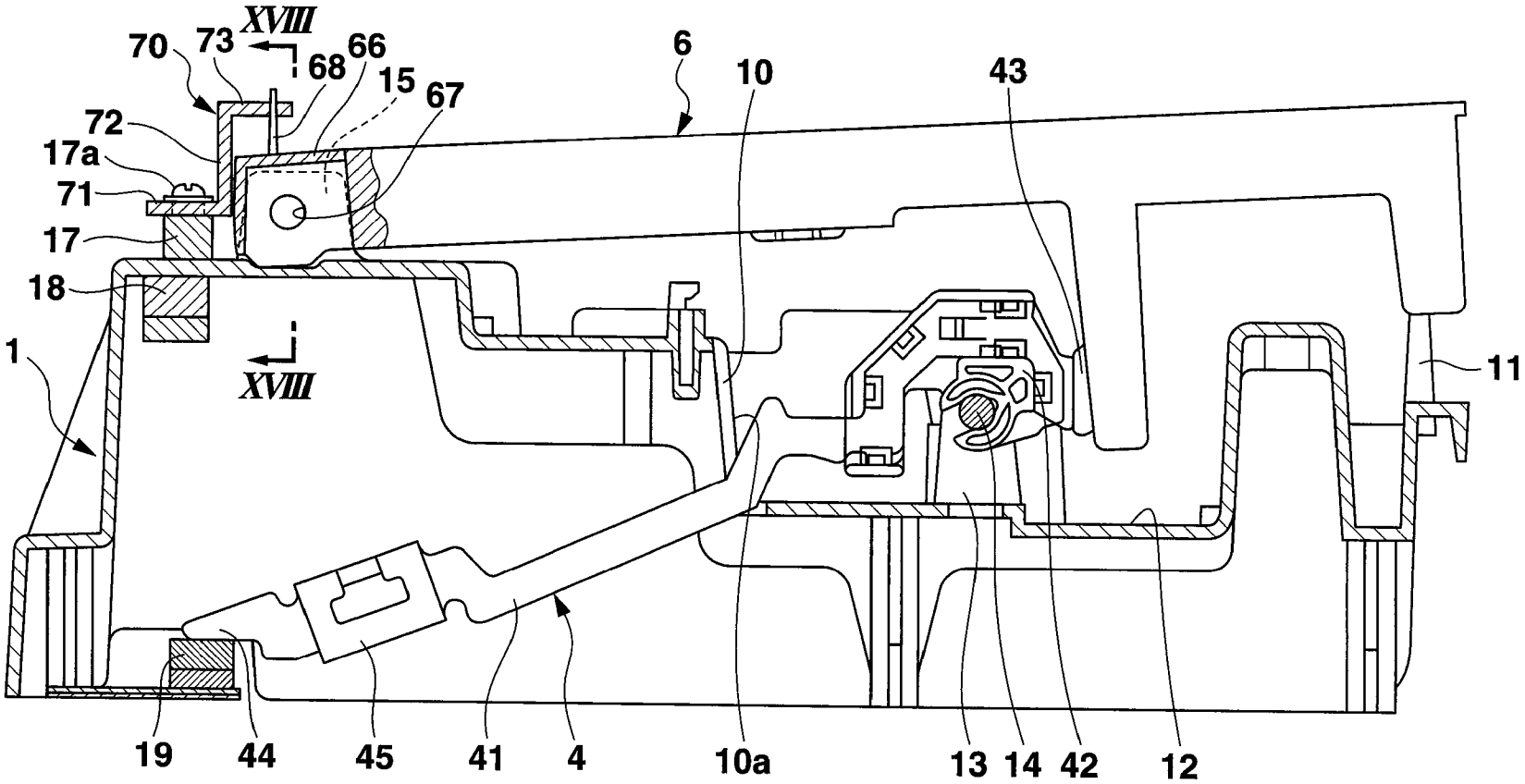
FIG. 14 is a side cross-sectional view of a keyboard device of a third embodiment in an unkeying state.
Figure 15:
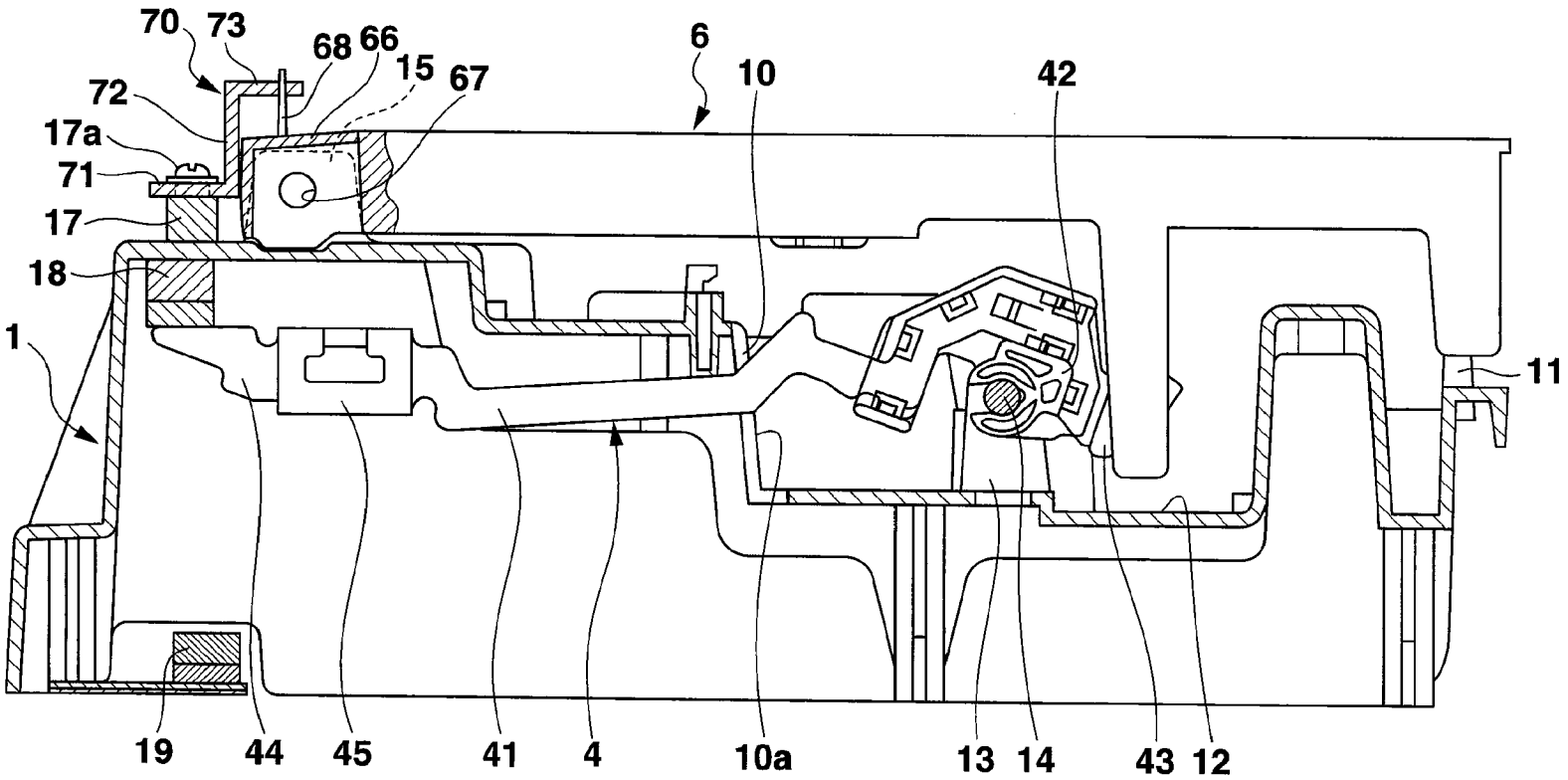
FIG. 15 is a side cross-sectional view of the keyboard device of the third embodiment in a keying state.

FIG. 14 and FIG. 15 are side cross-sectional views of the keyboard device in this embodiment. FIG. 14 shows a state where each of the keys is not keyed, and FIG. 15 shows a state where each of the keys is keyed.

In this embodiment, as shown in FIG. 14 and FIG. 15, with regard to the key 6, a rear end side thereof (left end side in FIG. 14 and FIG. 15) is formed as a chassis attachment portion 66 as an attached portion to the key supporting portion 15 of the keyboard chassis 1.

Figure 16:
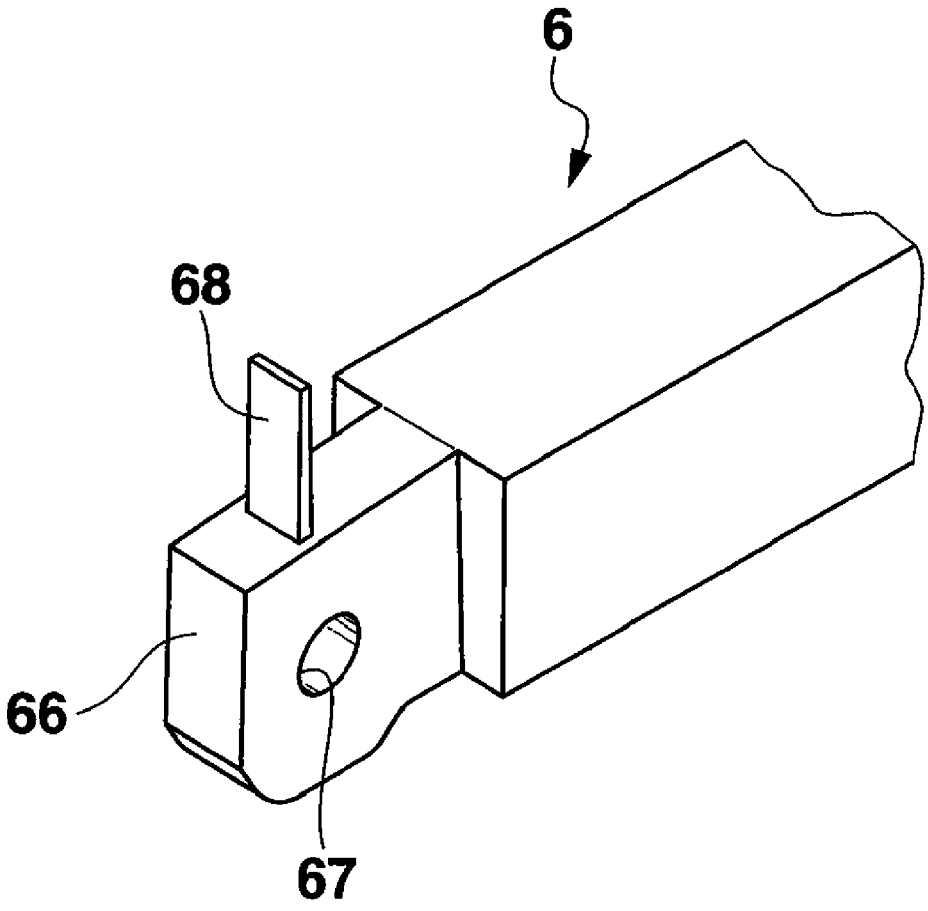
FIG. 16 is a perspective view of a chassis attachment portion of a key in the third embodiment.

FIG. 16 is a perspective view of the chassis attachment portion 66.

Figure 18:
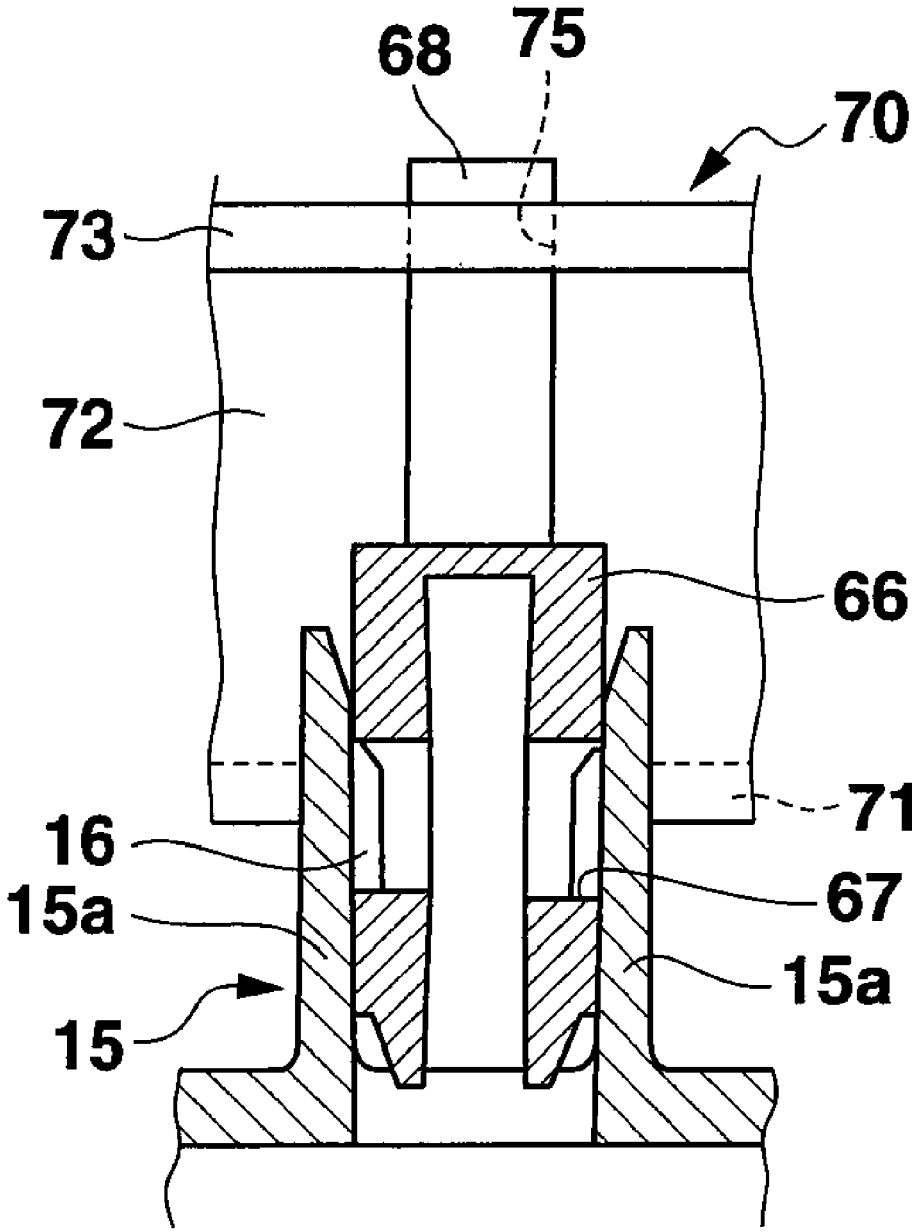
FIG. 18 is a cross-sectional view along a line XVIII-XVIII of FIG. 14.

As shown in FIG. 16, in this embodiment, in the chassis attachment portion 66, hole portions 67 fitted to the key supporting protruding parts 16 are formed at positions of the key supporting portion 15, which correspond to the key supporting protruding parts 16 (refer to FIG. 18). The key supporting protruding parts 16 are fitted to the hole portions 67, whereby the key 6 is adapted to rotationally move in the up-and-down direction (that is, the keying direction) about the key supporting protruding parts 16 taken as the rotation centers.

Note that, unlike the first embodiment and the second embodiment, the chassis attachment portion 66 has a configuration in which the opening portion is not provided on an upper surface; however, the inside of the chassis attachment portion may be either hollow or solid.

On an upper surface of the chassis attachment portion 66 in this embodiment, a protruding part 68 is erected substantially vertically. In this embodiment, the protruding part 68 is a protruding part provided on the chassis attachment portion 66 as the attached portion.

The protruding part 68 is a member with a thin plate shape, in which a thickness in a direction orthogonal to a width direction of the key 6 is thin. The protruding part 68 is formed integrally with the chassis attachment portion 66. In this embodiment, the protruding part 68 has a width dimension equal to or smaller than a widthwise dimension of the chassis attachment portion 66.

Note that it is sufficient if the protruding part 68 has flexibility to be bendable in response to the rotational movement of the key 6, and a shape, size, thickness and the like of the protruding part 68 are not limited to the illustrated example.

Figure 17A:
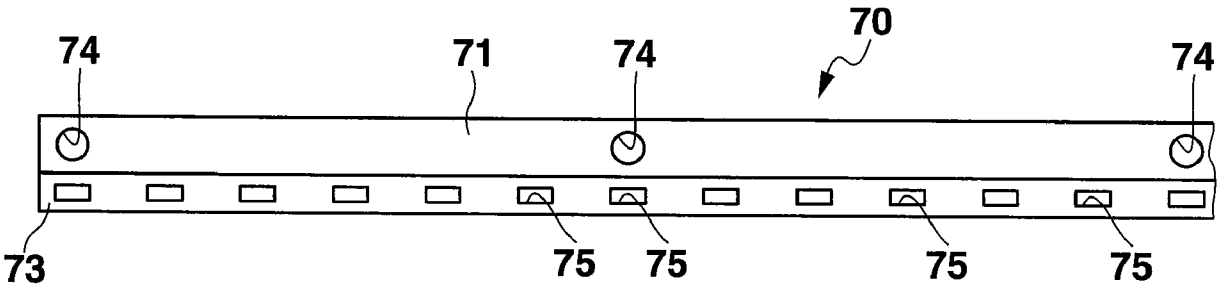
FIG. 17A is a top view of a key pressing member of the third embodiment.
Figure 17B:
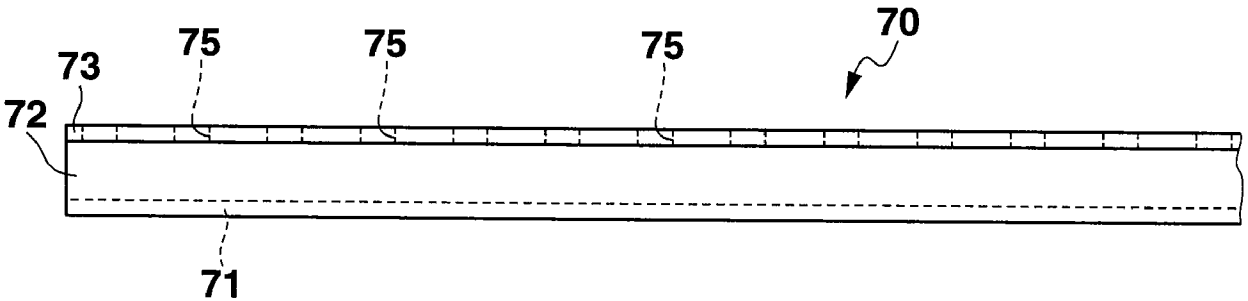
FIG. 17B is a front view of the key pressing member of the third embodiment.

Moreover, the keyboard chassis includes: key supporting portions 15 substantially similar to those of the first embodiment and the second embodiment; and a key pressing member 70 shown in FIG. 17A and FIG. 17B. A key attachment portion that attaches the keys 6 to the keyboard chassis 1 is composed of the key supporting portions 15 and the key pressing member 70.

FIG. 17A is a top view of the key pressing member 70, and FIG. 17B is a front view of the key pressing member 70 (that is, a view when viewed from a front side (right side in FIG. 14 and FIG. 15) of the keyboard device).

In this embodiment, the key pressing member 70 is a long member extended in the width direction of the keyboard device (that is, the transverse direction). As shown in FIG. 14, FIG. 17A and FIG. 17B, the key pressing member includes: a chassis fixing portion 71 with a flat plate shape, in which screw holes 74 are formed at positions corresponding to screw holes (not shown) of the fixing portion 17; an erected portion 72 erected substantially vertically from one longitudinal side of the chassis fixing portion 71; and an eave portion 73 extended substantially horizontally from an upper end of the erected portion 72 to an opposite side with the chassis fixing portion 71.

In the eave portion 73, engagement holes 75 which penetrate the same substantially in the vertical direction are formed at positions corresponding to the protruding parts 68 of the respective keys 6. The respective engagement holes 75 are engagement holes as recessed parts fitted to the protruding parts 68 as the protruding parts. Each of the engagement holes 75 has dimensions matched with a width and thickness of the protruding part 68 of each of the keys 6 so as to engage with the protruding part 68 substantially with no gap therebetween when the key pressing member 70 is installed on the keyboard chassis 1.

FIG. 18 is a cross-sectional view along a line XVIII-XVIII in FIG. 14.

As shown in FIG. 18, the protruding part 68 erected on the upper surface of the chassis attachment portion 66 of each of the keys 6 is inserted through each of the engagement holes 75 provided in the key pressing member 70 so as to correspond thereto. The protruding part 68 is adapted to be fitted to the engagement hole 75 substantially with no gap therebetween.

Note that, since other configurations are similar to those shown in the first embodiment and the second embodiment, the same reference numerals are assigned to the same members, and a description thereof is omitted.

Next, a description is made of functions of the keyboard device in this embodiment.

When each of the keys 6 is attached to the keyboard device, the chassis attachment portion 66 as the attached portion of the key 6 is fitted from above into the key supporting portion 15 of the keyboard chassis.

Next, the key pressing member 70 is screw fixed to the fixing portion 17 of the keyboard chassis 1 in such an orientation where a side on which the eave portion 73 is provided is located on the front side (right side in FIG. 14 and FIG. 15) of the keyboard device.

At this time, as shown in FIG. 18, the protruding part 68 of each of the keys 6 is inserted into the engagement hole 75 of the key pressing member 70, and is adapted to be fitted thereto substantially with no gap. In such a way, the chassis attachment portion 66 is surely pressed from above by the key pressing member 70, the lift and drop of the key 6 are prevented, and in addition, the inclination and wobbling of the key 6 in the transverse direction are suppressed.

Then, at the keying time, the protruding part 68 is bendable in a fore-and-aft direction of the keyboard device (that is, a right-and-left direction in FIG. 14 and FIG. 15). In such a way, even in a state where the protruding part 68 is left inserted into the engagement hole 75, the key 6 can be rotationally moved smoothly in the up-and-down direction (that is, the keying direction).

As described above, in accordance with this embodiment, each of the protruding parts 68 of the chassis attachment portions 66, which are the protruding parts, is inserted into each of the engagement holes 75 of the key pressing member 70, which are recessed parts, and is fitted thereto substantially with no gap therebetween. Accordingly, even in the case where a strong impact is applied to the key 6 from the outside, the key 6 can be prevented from dropping off or being lifted from the keyboard chassis 1.

Moreover, at the keying time, the protruding part 68 is freely bendable in the fore-and-aft direction of the keyboard device (that is, the right-and-left direction in FIG. 14 and FIG. 15). In such a way, even in the state where the protruding part 68 is left inserted into the engagement hole 75, the key 6 can be rotationally moved smoothly in the up-and-down direction. Therefore, no excessive load is applied to the key 6, and the key 6 can be stabilized without interfering with the playability.

Moreover, the protruding part 68 is fitted to the engagement hole 75 with no gap therebetween. In such a way, the inclination and wobbling of the key 6 can be prevented even if the key 6 is pressed down in the transverse direction and the diagonal direction.

Moreover, the protruding part 68 of each of the keys 6 is inserted into each of the engagement holes 75 of the key pressing member 70, which is extended in the width direction of the keyboard device (that is, the transverse direction), and has the plurality of engagement holes 75 formed therein so as to correspond to the plurality of keys 6. Accordingly, twist, inclination, wobbling and the like of the key 6 in the transverse direction can be suppressed more surely.

In particular, in this embodiment, the protruding part 68 is formed into the thin plate shape in which the thickness in the direction orthogonal to the width direction of the key 6 is thin, and accordingly, the twist, inclination, wobbling and the like thereof in the transverse direction can be suppressed far more surely.

Moreover, appropriate pressing force can be applied to a basal portion of the key 6 by the key pressing member 70, and accordingly, the natural key touch feeling approximate to that of the acoustic piano can be obtained.

Note that, in this embodiment, the description has been made of the example where the protruding part 68 as the protruding part is erected substantially vertically on the upper surface of the chassis attachment portion 66; however, the position at which the protruding part 68 is not limited to this.

Figure 19:
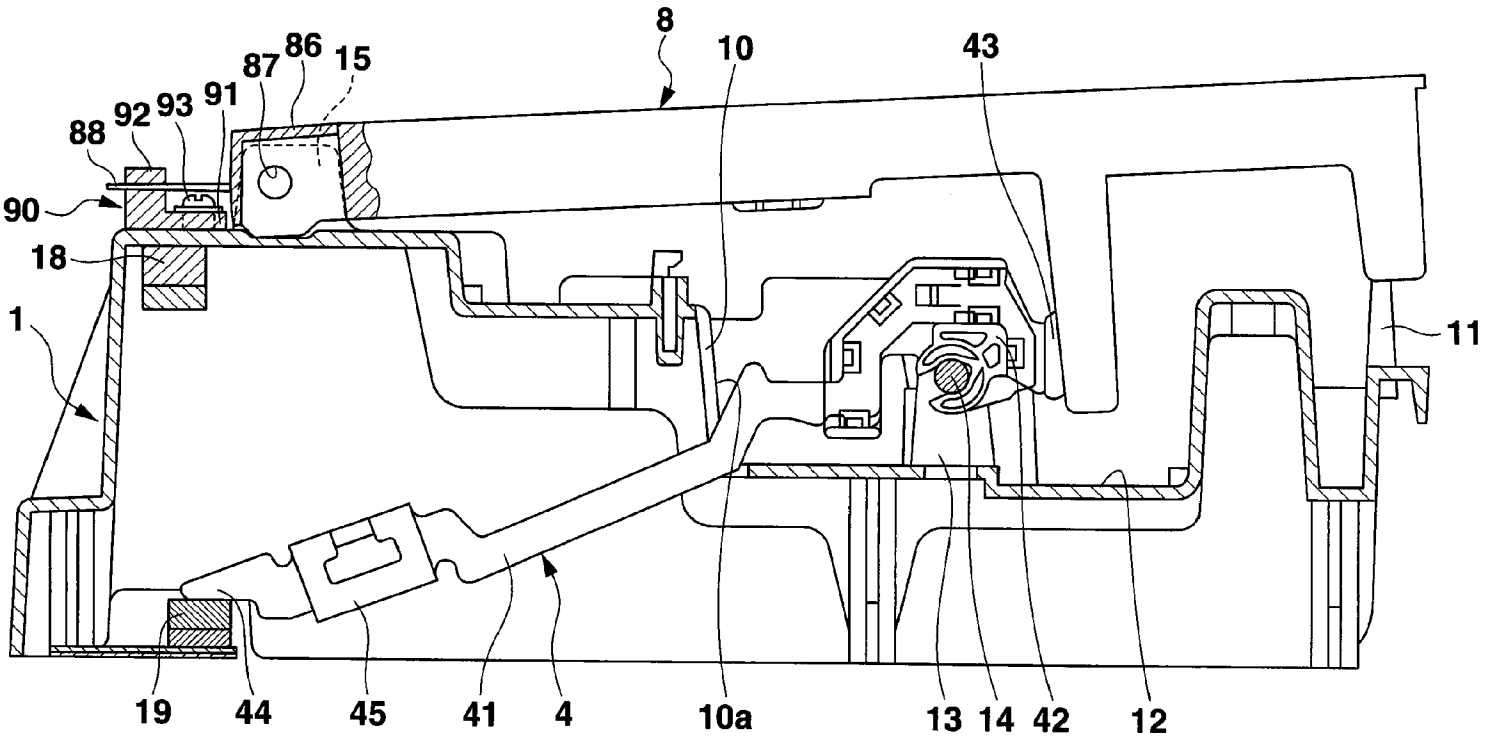
FIG. 19 is a side cross-sectional view of a keyboard device of a modification in an unkeying state.
Figure 20:
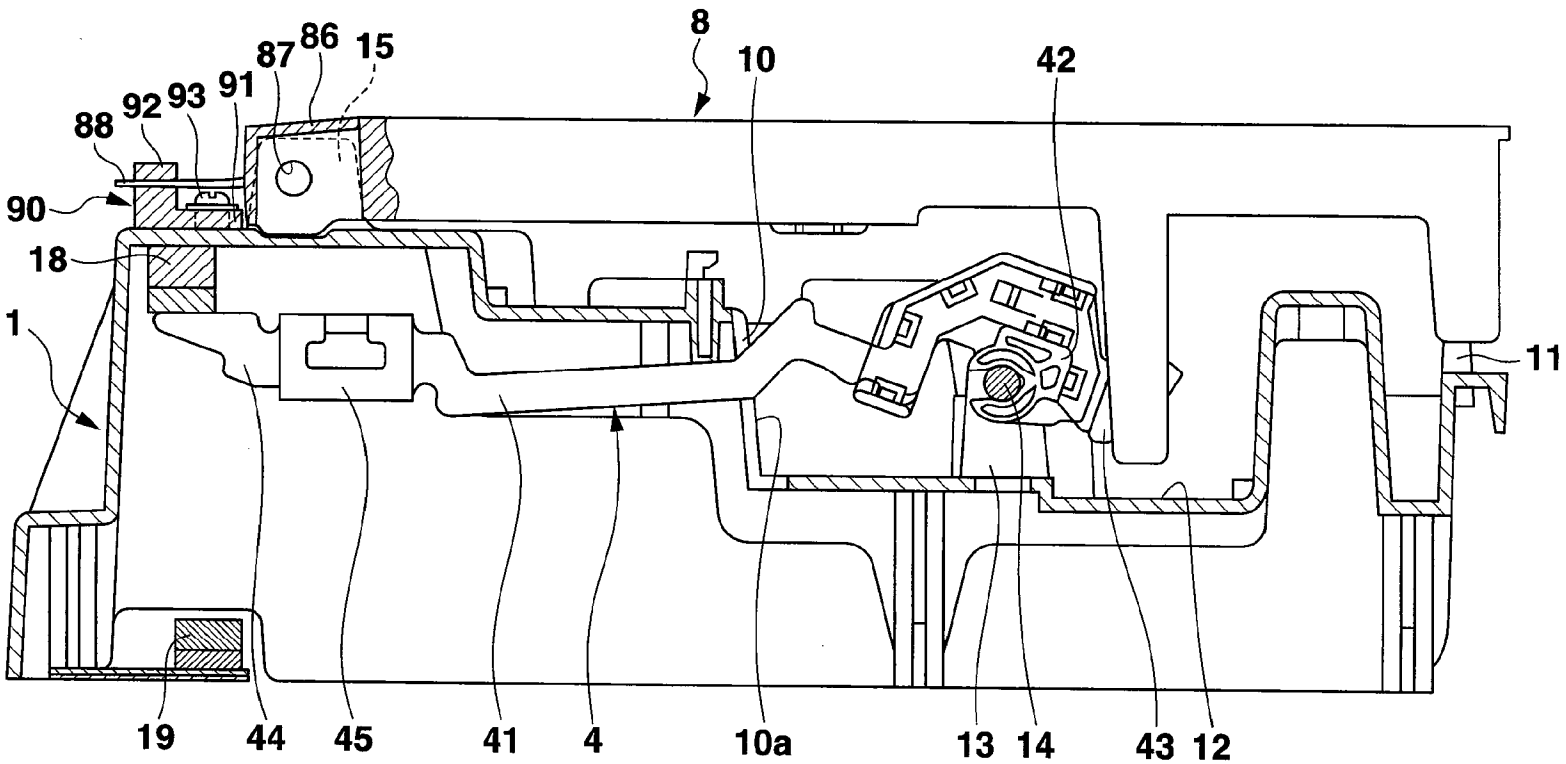
FIG. 20 is a side cross-sectional view of the keyboard device of the modification in a keying state.
Figure 21:
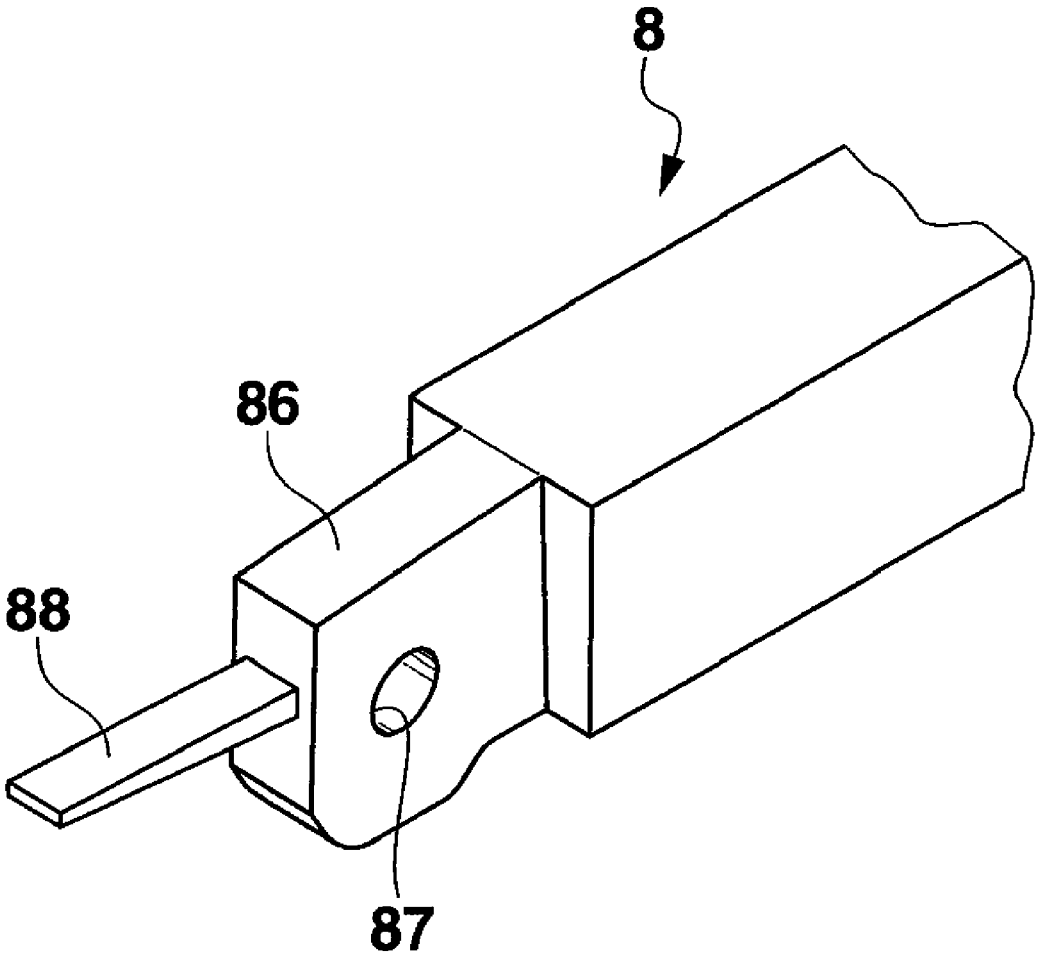
FIG. 21 is a perspective view of a chassis attachment portion of a key in the modification.

For example, as shown in FIG. 19 to FIG. 21, a protruding part 88 that protrudes substantially in the horizontal direction may be provided on a rear end surface (left end surface in FIG. 19 and FIG. 20) of a chassis attachment portion of each of keys 8. Also in this case, the protruding part 88 is formed into a thin plate shape in which a thickness in a direction orthogonal to a width direction of the key 8 is thin, and is configured to have flexibility so as to be freely bendable in the up-and-down direction (that is, the keying direction) at the keying time. Note that, also in this case, a shape, width dimension, thickness and the like of the protruding part 88 are not particularly limited as long as the protruding part 88 is bendable.

In the case where the protruding part 88 as the protruding part is provided on the rear end surface of the chassis attachment portion 86 as described above, a key pressing member 90 that presses the keys 8 is configured in the following manner for example.

Figure 22B:
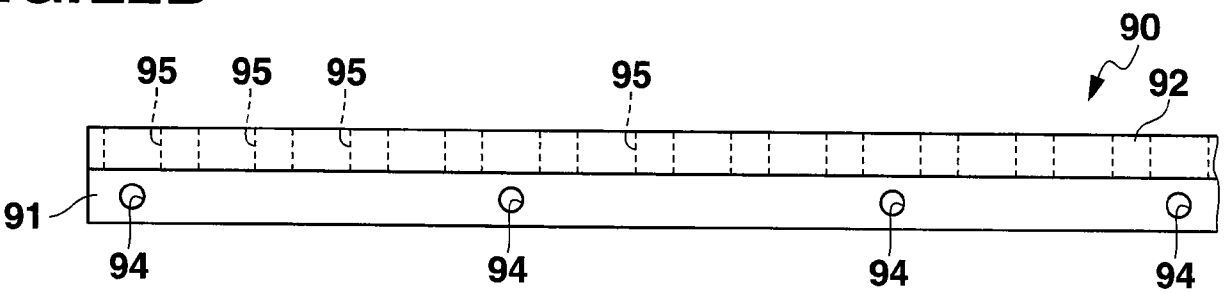
FIG. 22B is a top view of the key pressing member of the modification.
Figure 22C:
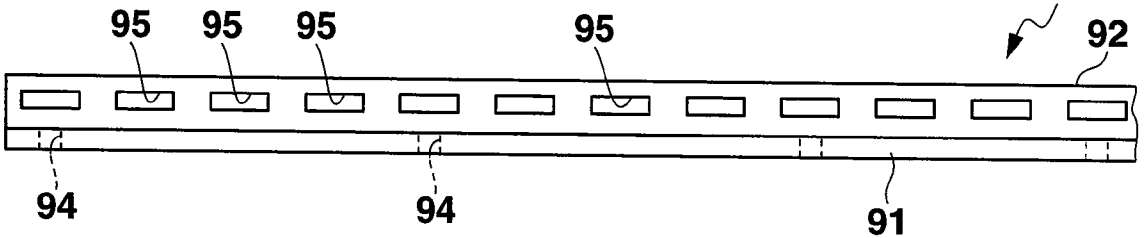
FIG. 22C is a front view of the key pressing member of the modification.
Figure 22A:
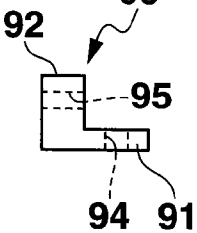
FIG. 22A is a side vide of a key pressing member of the modification.

FIG. 22A is a side cross-sectional view of the key pressing member 90 shown in FIG. 19 and FIG. 20. FIG. 22B is a top view of the key pressing member 90. FIG. 22C is a front view of the key pressing member 90.

As shown in FIG. 22A to FIG. 22C, the key pressing member 90 is a member in which a cross section is substantially an L shape. The key pressing member 90 includes: a chassis fixing portion 91 with a flat plate shape, in which screw holes 94 for screwing the key pressing member 90 to the keyboard chassis 1 are formed; and an erected portion 92 erected substantially vertically from one longitudinal side of the chassis fixing portion 91. The key pressing member 90 is fixed to the keyboard chassis 1 by screws 93.

In the erected portion 92, engagement holes 95 as recessed parts which penetrate the same substantially in the horizontal direction are formed at positions corresponding to the protruding parts 88 of the respective keys 8. Each of the engagement holes 95 is set to have dimensions matched with a width and thickness of the protruding part 88 of each of the keys 8 so as to engage with the protruding part 88 substantially with no gap therebetween when the key pressing member 90 is installed on the keyboard chassis 1.

Even in the case of adopting such configurations for the protruding part 88 and the key pressing member 90, the protruding part 88 of each of the keys 8 is inserted into the engagement hole 95 of the key pressing member 90, and is fitted thereto. Accordingly, the chassis attachment portion 86 is surely pressed from above by the key pressing member 90, and the inclination and wobbling of the key 8 in the transverse direction are suppressed. Then, at the keying time, as shown in FIG. 20, the protruding part 88 is bendable in the up-and-down direction (keying direction) of the keying device. In such a way, even in a state where the protruding part 88 is left inserted into the engagement hole 95, the key 8 can be rotationally moved smoothly in the up-and-down direction.

Moreover, in this embodiment, the description has been made of, as an example, the case of including the engagement holes 75 (engagement holes 95), which penetrate the eave portion 73 (erected portion 92) substantially in the horizontal direction, as the recessed parts; however, it is sufficient if the recessed parts are fitted to the protruding parts 68 (protruding parts 88) as the protruding parts, and the recessed parts are not limited to the through holes.

Moreover, in this embodiment, the description has been made of the case where each of the protruding parts 68 (protruding parts 88) is the member with the thin plate shape, in which the thickness in the direction orthogonal to the width direction of the key is thin; however, the shape of the protruding part 68 (protruding part 88) is not limited to this. For example, each of the protruding parts may be formed of a flexible member with a slim stick shape.

Note that, in each of the above-described embodiments, as an example, the case has been illustrated, where the key pressing member is the long member extended in the width direction of the keyboard device (that is, the transverse direction); however, one key pressing member, which is provided across the overall width of the keyboard device and corresponds to all of the keys, may be provided, or alternatively, a plurality of key pressing members with a dimension shorter than that of the above may be provided. For example, key pressing members which correspond to the respective keys one by one may be provided, or alternatively, key pressing members which individually correspond to sets, each having several keys, may be provided.

Moreover, in the first embodiment and the second embodiment, as an example, the case has been described, where the rib, the sliding portions and the insertion pieces are suspended substantially vertically from the longitudinal end portion of the eave portion; however, configurations of the rib, the sliding portions and the insertion pieces are not limited to these. For example, the sliding portions may be those thrust against the keys from the oblique rear, and the insertion pieces may be those inserted into the insides of the keys from the oblique rear.

Furthermore, the shapes of the sliding portions and the insertion pieces are not limited to those illustrated here.

Moreover, in each of the above-described embodiments, the case has been illustrated, where the key pressing member is composed of one component; however, a configuration of the key pressing member is not limited to this.

For example, in the key pressing members in the first embodiment and the second embodiment, such a configuration may be adopted, in which the chassis fixing portion, the erected portion and the eave portion are formed as one component from a material such as metal, and the rib, the sliding portions and the insertion pieces are formed of a material such as resin. Then, both thereof are fixed to each other by using adhesive, screws and the like, and are thereby integrated with each other. Moreover, configurations and the like of the rib, the sliding portions and the insertion pieces are not limited to the illustrated examples, and are changeable as appropriate.

Besides the above, it is a matter of course that the present invention is not limited to each of the above-described embodiments, and is changeable as appropriate.

What is claimed is:

1. A keyboard device comprising:

a keyboard chassis;

a plurality of keys attached to the keyboard chassis rotatably in a keying direction;

a plurality of key attachment portions in the keyboard chassis to which the keys are attached; and an attached portion on one end of each of the keys for attaching the key to a corresponding key attachment portion;

wherein either the attached portion or each of the key attachment portions comprises a recessed part, and the other portion comprises a protruding part; and wherein the recessed part and the protruding part are configured to engage with each other.

2. The keyboard device according to claim 1, wherein the recessed part is provided on each of the attached portions, and the protruding part is provided on each of the key attachment portions;

wherein an upper portion of the attached portion is formed into a circular arc shape, a center of which is located at a rotation center of the key, and an opening portion is provided as the recessed part in the upper portion of the attached portion;

wherein each of the key attachment portions comprises a key pressing member including a sliding portion as the protruding part, the key pressing member being formed into a mountain shape by a pair of mountain ridge portions inclined toward a widthwise center of the key; and wherein a vertex of the key pressing member is inserted into the opening portion of the attached portion, and thereby the key pressing member is configured to slide along an end edge of the opening portion at a keying time.

3. The keyboard device according to claim 1, wherein the recessed part is provided on each of the attached portions, and the protruding part is provided on each of the key attachment portions;

wherein an upper portion of the attached portion is formed into a circular arc shape, a center of which is located at a rotation center of the key, and an opening portion is provided as the recessed part in the upper portion of the attached portion;

wherein each of the key attachment portions comprises a key pressing member including:

(a) an insertion piece inserted into the opening portion of the attached portion as the protruding part; and (b) a sliding portion provided on each of both sides of the insertion piece, the sliding portion being formed by a pair of mountain ridge portions inclined toward a widthwise center of the key, and contacting with an end edge of the opening portion, and thereby the key pressing member is configured to slide along the end edge of the opening portion at a keying time.

4. The keyboard device according to claim 1, wherein the protruding part is provided on each of the attached portions, and the recessed part is provided on each of the key attachment portions;

wherein the attached portion includes, as the protruding part, a flexible protruding part being bendable in response to a rotational movement of the key; and wherein each of the key attachment portions comprises a key pressing member including an engagement hole as the recessed part fitted to the corresponding protruding part.

5. The keyboard device according to claim 4, wherein each of the protruding part is formed into a thin plate shape in a direction orthogonal to a width direction of the key.

* * * * *